US005282599A

United States Patent [19]

Arpaia et al.

[11] Patent Number: 5,282,599

[45] Date of Patent: Feb. 1, 1994

[54] PORTABLE URINAL AND RECEPTACLE FOR PORTABLE URINAL

[76] Inventors: Josephine J. Arpaia; Paschal J. Arpaia, both of 1500 E. Whitney Rd., Fairport, N.Y. 14450

[21] Appl. No.: 984,520

[22] Filed: Dec. 2, 1992

[51] Int. Cl.[5] ..... A47K 1/08

[52] U.S. Cl. ..... 248/311.2; 4/144.1; 5/503.1; 211/88; 224/42.46; 248/214

[58] Field of Search ..... 4/144.1, 144.3; 5/503.1, 658; 220/482; 224/42.45 R, 42.46; 248/214, 215, 305, 311.2; 135/66, 67; 211/86, 88

[56] References Cited

U.S. PATENT DOCUMENTS

| | | | |
|---|---|---|---|
| 2,673,990 | 4/1954 | Edwards | 248/311.2 X |
| 3,568,217 | 3/1971 | Anderson | 4/144.1 |
| 3,586,276 | 6/1971 | O'Mahoney | 248/215 X |
| 3,653,624 | 4/1972 | Abel | 248/215 X |
| 4,449,750 | 5/1984 | Pultman | 224/42.46 X |
| 4,491,257 | 1/1985 | Ingles | 224/42.46 X |
| 4,573,653 | 3/1986 | Boettger | 248/311.2 X |

*Primary Examiner*—Charles E. Phillips
*Attorney, Agent, or Firm*—Robert J. Bird

[57] ABSTRACT

A receptacle for a portable urinal includes a front wall, back wall, and side walls, with a vertical exterior recess in the back wall. Support hooks on the back wall extend above and below the back wall, the hook portion adapted to hang on a bed rail. The hooks further include inward tabs to partially encircle the supporting bed rail. The receptacle hangs on one horizontal bar of a bed rail and rests against the next lower horizontal bar for stability, or it hangs on a horizontal bar of a bed rail, with the vertical recess engaged by a vertical bar of the bed rail for stability.

A portable urinal includes a front wall, back wall, and side walls, and a vertical exterior recess in the back wall. A handle connects to the upper portion of the back wall with gripping fingers so the urinal hangs on a horizontal bar with stability. The vertical recess is for stable engagement by a vertical bed rail member. The front wall is narrower than the back wall to facilitate placement of the urinal for use.

1 Claim, 4 Drawing Sheets

PORTABLE URINAL AND RECEPTACLE FOR PORTABLE URINAL

FIELD OF THE INVENTION

This invention is a receptacle for a portable urinal of the type used in hospitals, nursing homes, and the like. The invention is also a portable urinal by itself.

BACKGROUND INFORMATION

Hospital patients and others who are confined to their beds use hand held portable urinals which are emptied from time to time by an attendant. These urinals must be kept somewhere within the reach of the patient.

A hospital room typically includes a number of things in the immediate area of the patient's bed, such as a bedside stand, overbed table, water pitcher, waste basket, electric lines, oxygen equipment, suctioning equipment, personal care articles, flowers, and cards. The portable urinal presently in use is designed to hang from the bedside rail, but it does not hang securely, and is known to fall from the rail, forcing the patient or user to set the urinal wherever space can be found, e.g. on the floor, on the bedside table, or even on the overbed table where food is served.

A portable urinal is not a very stable standing vessel. A urinal which is simply set down in the space most conveniently reached, especially in this usually crowded and cumbersome setting, is liable to be stumbled into and knocked over, and its contents spilled. When this happens, everything that comes in contact with the spilled urine is contaminated. There is then the added work and expense of cleaning up an unnecessary spill.

This relatively offhand manner in which portable urinals are generally handled contributes to the spread of nosocomial infections. Nosocomial infection is an infection acquired during hospitalization, often caused by *Candida albicans, Escherichia coli,* hepatitis viruses, herpes zoster virus, pseudomonas, or staphyloccus. It is also simply called "hospital acquired infection".

Sterile materials, dressings, solutions, medications, and the like are often kept on the bedside table. These sterile materials can become contaminated from a urinal placed so nearby, and thus becomes a source of infection. This is just one example of the problem.

In addition to the biological problem of infection, the urinal can also be a psychological problem. Having a container of the patient's urine in view is detrimental to the morale and emotional well being of the patient.

A proper place to keep a portable urinal is therefore to be desired, and is the object of this invention. A "proper place" for a portable urinal is one which provides upright stability, is out of the way of traffic, out of sight, and conveniently within reach of the user and attendants.

SUMMARY OF THE INVENTION

The present invention is a receptacle for a portable urinal. The receptacle includes a front wall, back wall, and side walls, with a vertical exterior recess in the back wall. Support hooks on the back wall extend above and below the back wall, the hook portion adapted to hang on a bed rail. The hooks further include inward tabs to partially encircle the supporting bed rail. The receptacle hangs on one horizontal bar of a bed rail and rests against the next lower horizontal bar for stability, or it hangs on a horizontal bar of a bed rail, with the vertical recess engaged by a vertical bar of the bed rail for stability.

The invention is also a portable urinal with a front wall, back wall, and side walls, and a vertical exterior recess in the back wall. A handle connects to the upper portion of the back wall with gripping fingers so the urinal hangs on a horizontal bar with stability. The vertical recess is for stable engagement by a vertical bed rail member. The front wall is narrower than the back wall to facilitate placement of the urinal for use.

DRAWING

DESCRIPTION

Figure 1:
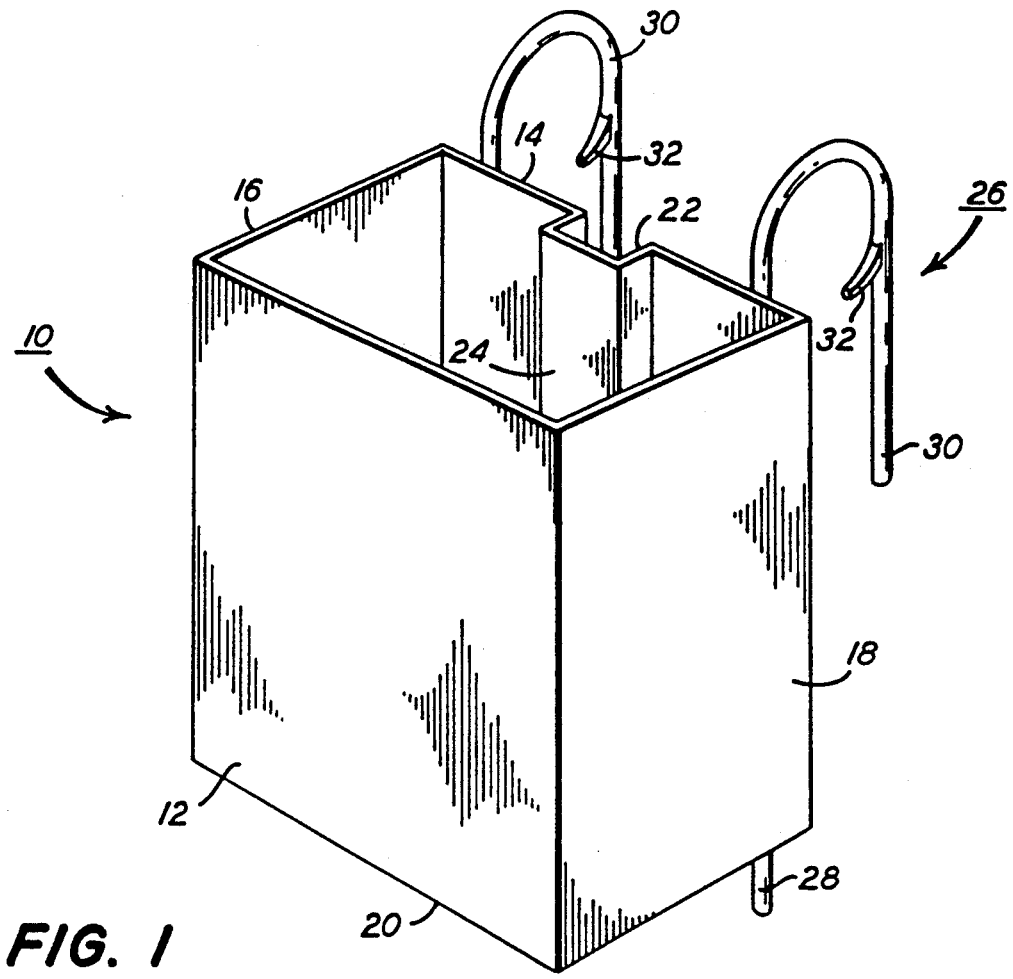
FIG. 1 is a perspective view of a receptacle according of this invention.
Figure 2:
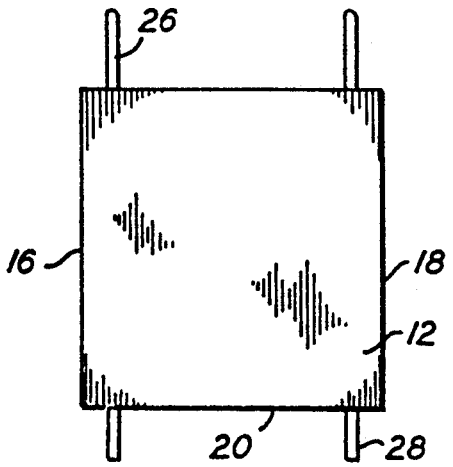
FIG. 2 is a front view of the receptacle.
Figure 3:
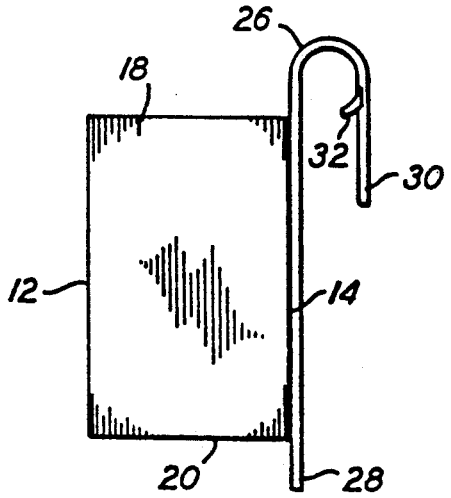
FIG. 3 is a right side view of the receptacle.

Referring to FIGS. 1-3, a receptacle 10 includes a front wall 12, back wall 14, left side wall 16, right side wall 18, and bottom 20. The walls and bottom are generally square, being 12.5 cm on a side. The back wall 14 includes a central section 24 which is offset inward of the adjacent sections to give the back wall a vertical exteriorly concave recess 22.

The receptacle 10 includes a pair of support hooks 26, each including a longer arm 28 and a shorter arm 30. The longer arm 28 of each hook is fixed to the back wall 14, extending above and below it. The shorter arm 30 extends over and hangs on a horizontal bar 40 of a bed rail. The longer arm 28 extends 23 cm down from the bight. The shorter arm 30 extends 12 cm down from the bight. The shorter arm 30 further includes a flexible tab 32 which extends inward to partially surround the bar 40.

Hospital beds generally include movable bed rails which can be raised when appropriate as a safety device to keep the patient from falling out of bed. There are two general types of these bed rails. One type is essentially of horizontal bars extending lengthwise along the bed. The other type is essentially of vertical bars extending from top to bottom. In either case, the top member is a horizontal bar 40.

Figure 4:
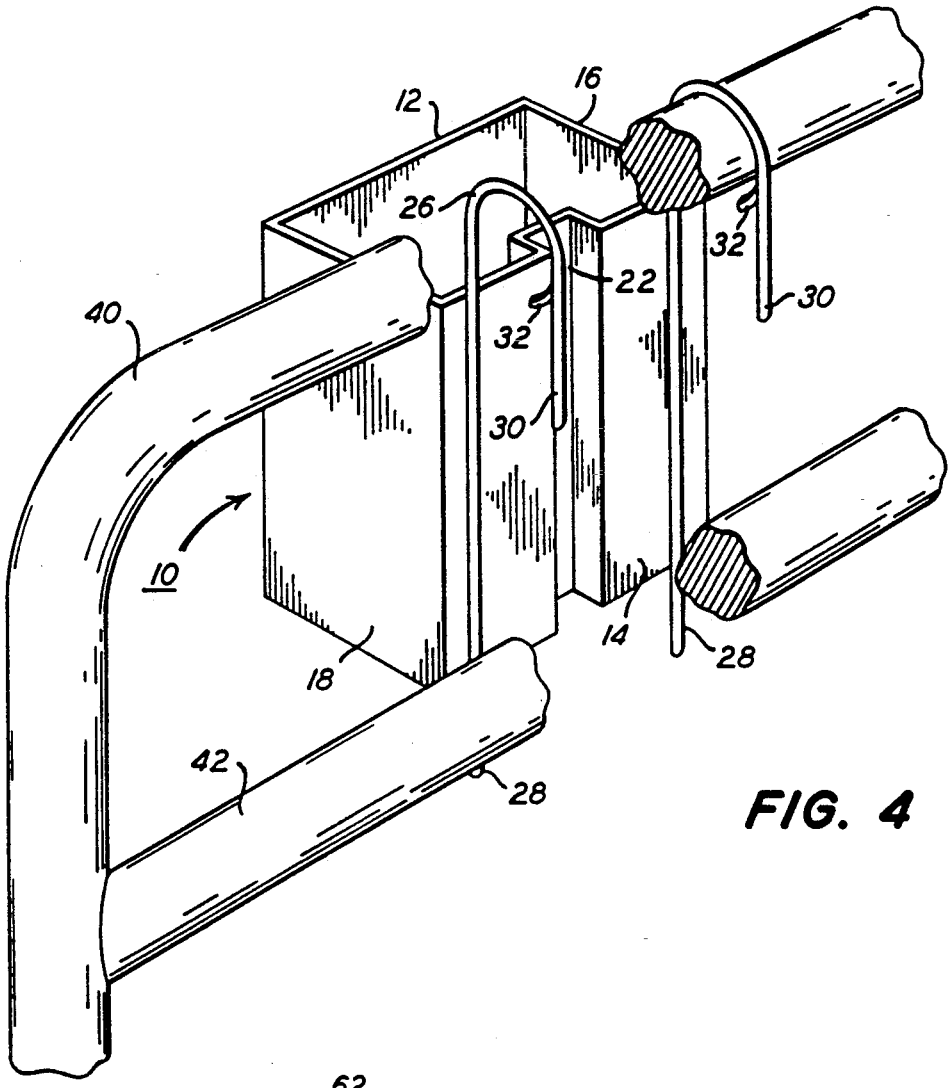
FIG. 4 is a perspective view of the receptacle mounted on a bed rail with horizontal bars.

FIG. 4 shows the receptacle 10 on a bed rail with a horizontal top bar 40 and a horizontal bar 42 below it (15 cm on centers). There are no vertical members. The receptacle 10 hangs on the top bar 40. The lower ends of the arms 28 rest against the lower horizontal bar 42, giving stability to the hanging receptacle. The receptacle hangs, but does not rock or swing in any plane transverse of the bed rail. In addition, the tabs 32 prevent the receptacle 10 from rocking or swinging in any plane parallel to the bed rail.

Figure 5:
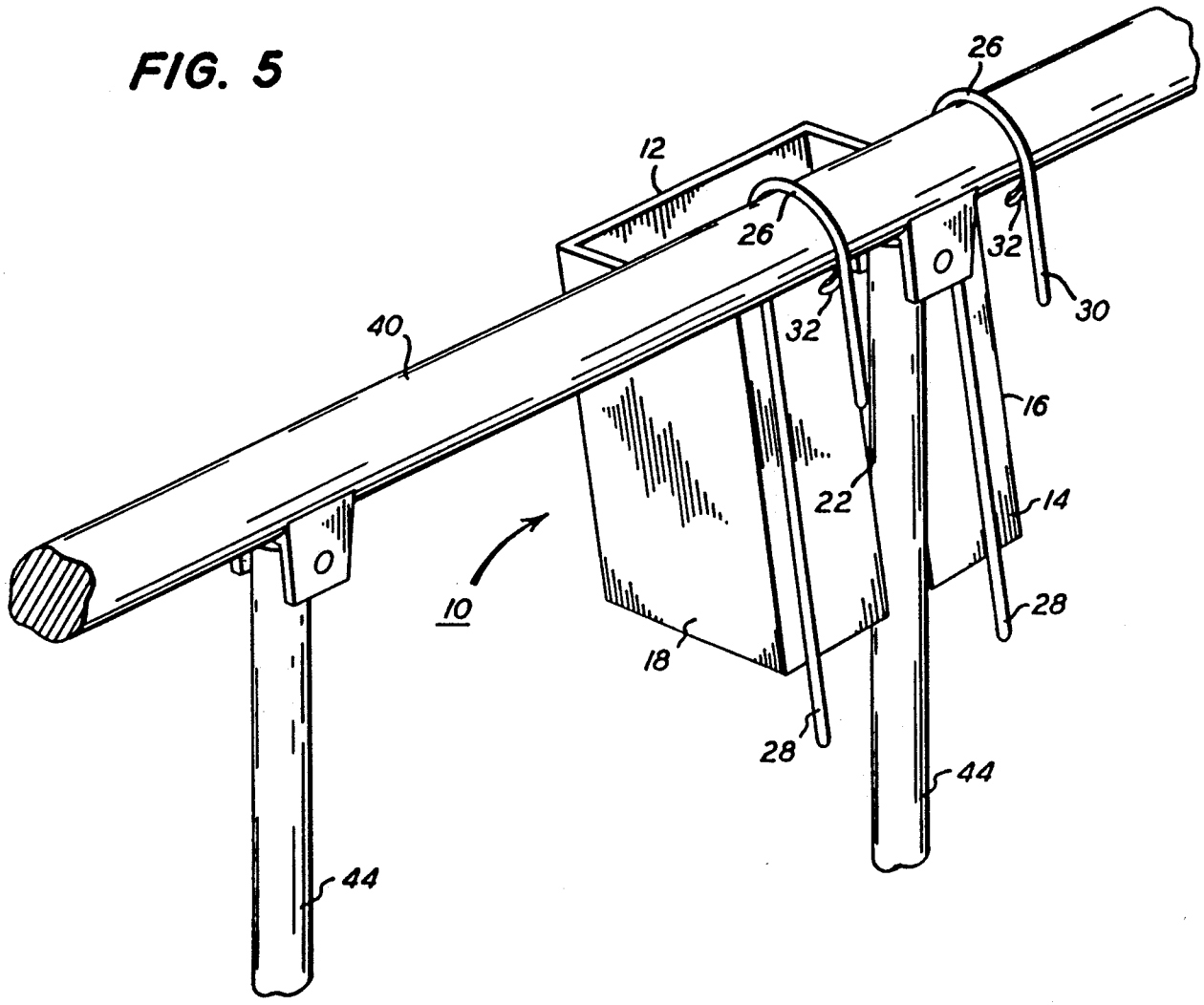
FIG. 5 is a perspective view of the receptacle mounted on a bed rail with both horizontal and vertical bars.

FIG. 5 shows the receptacle 10 on a bed rail with a horizontal top bar 40 and a number of vertical bars 44. The receptacle 10 hangs on the top bar 40. The back wall 14 of the receptacle, with its vertical recess 22 engages one of the vertical bars 44 of the bed rail, in a "tongue and groove" manner. In this setting, the receptacle is prevented from swinging by the vertical bar 44, and by the tongue and groove engagement which maintains the horizontal position of the receptacle 10 on the horizontal bar 40. As in the setting of FIG. 4, the receptacle hangs, but does not rock or swing in any plane transverse of the bed rail or in any plane parallel to the bed rail.

The receptacle 10 and its support hooks 26 are of a resilient plastic material. The device can be sterilized and is reusable.

The receptacle 10 provides the desired proper place for a portable urinal. It holds the urinal upright and stable, up and out of the way of foot traffic, and conveniently within reach of the user. The urinal placed within it is substantially out of sight. It contributes to the cleanliness and order of its environment. The receptacle can also be used to hold specimens obtained at patient's bedside.

Figure 7:
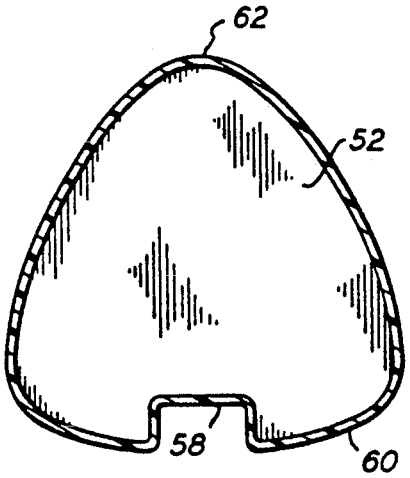
FIG. 7 is a transverse section of the urinal on the plane 7—7 of FIG. 6.
Figure 6:
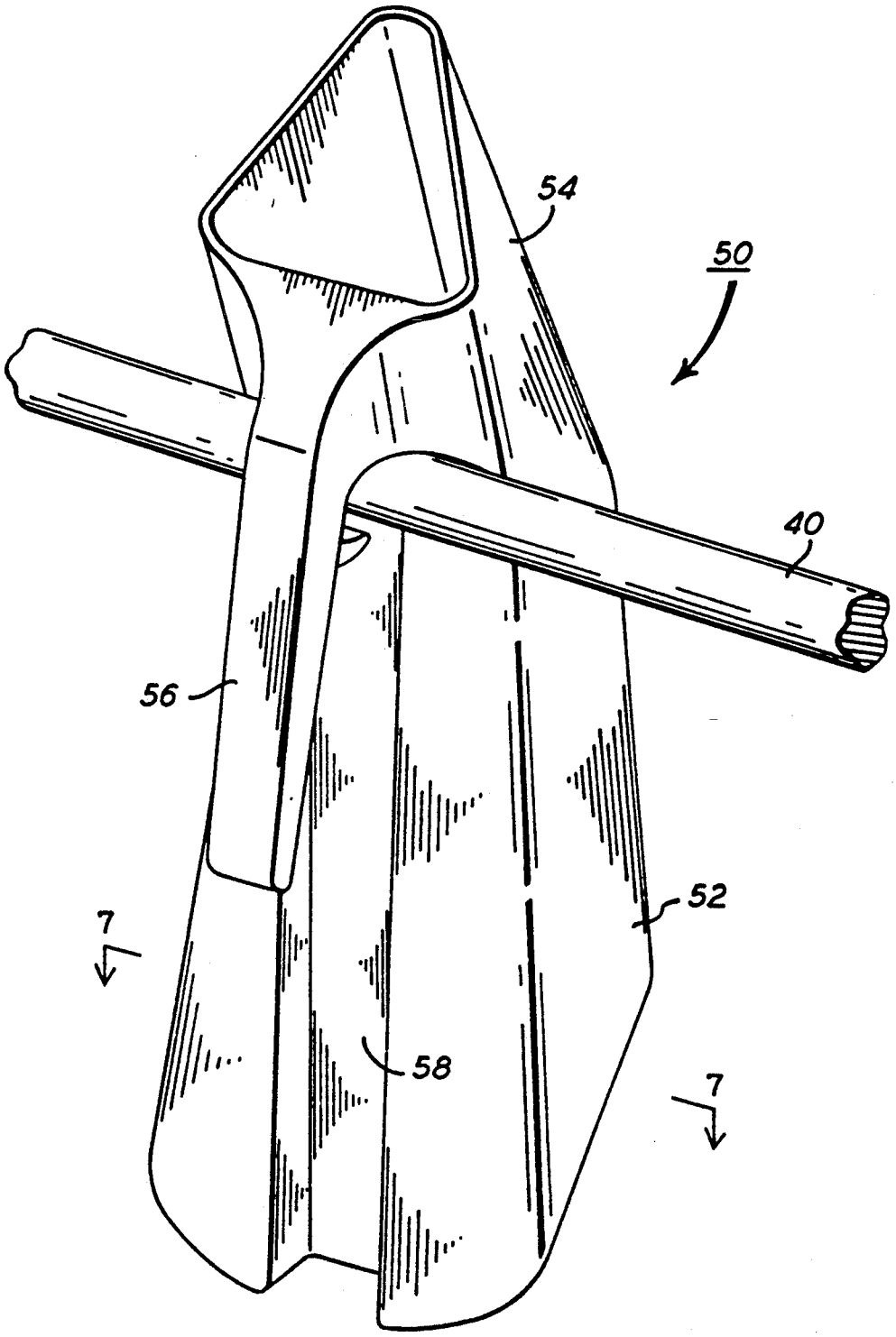
FIG. 6 is a perspective view of a urinal according to this invention.

FIGS. 6 and 7 show a urinal according to another form of this invention. The urinal 50 includes a vessel 52 with an upper portion 54 canted relative to the lower portion. A handle 56 connects to the upper portion 54 across an extended width of the upper portion 54 and extends down from it, straddling a bar 40 of a bed rail to thereby hang the urinal 50 on the bar 40. Resilient gripping fingers 55 and 57, one on each side of the handle 56, grip the bar 40 so that the urinal 50 hangs on the bar with stability. The vessel is of a translucent material, but includes a transparent vertical strip for a sight gage through which the vessel contents are visible. The vessel also includes a snap-on cover, not shown.

The vessel 52, directly under and behind the handle 56, includes a vertical exteriorly concave recess 58, similar to the recess 22 in the receptacle 10, and for the same reason. The urinal 50 hangs on a horizontal bar 40 of a bed rail. If the bed rail also includes vertical bars 44 of the type shown in FIG. 5, the vertical recess 58 engages a vertical bar of the bed rail. The urinal is thus further prevented from swinging by this tongue and groove engagement with the vertical bar 44. The urinal hangs, but does not rock or swing on the bed rail.

Figure 8:
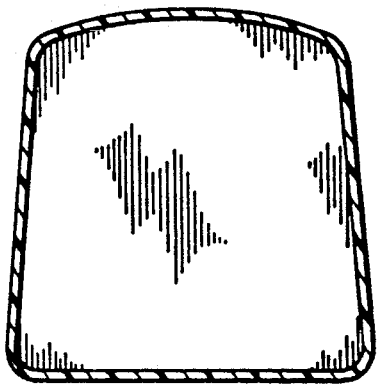
FIG. 8 (PRIOR ART)
FIG. 8 is a similar section of a standard urinal of the prior art.

FIG. 7 shows an additional feature of this urinal. The vessel 52 of the urinal 50 includes back and front walls 60 and 62. The back wall 60 is on the side of the handle 56 and the recess 58. In use, the urinal is placed with the front 62 down. FIG. 8 shows the general shape of a standard prior art urinal. The shape of our urinal (FIG. 7), with its narrower front wall 62, makes it easier to put in position for use, and is more comfortable than, the standard urinal of the prior art (FIG. 8).

The foregoing description of preferred embodiments of this invention, including any dimensions, angles, or proportions, is intended as illustrative. The concept and scope of the invention are limited only by the following claims and equivalents thereof.

What is claimed is:

1. A receptacle for a portable urinal, said receptacle including:

a front wall, and a back wall, connected by walls;

said back wall including a central vertical exteriorly concave recess along the height of said wall;

a pair of support hooks, each hook including a longer arm fixed to and extending above and below said back wall, and a shorter arm attached to said longer arm above said receptacle and being adapted to extend over and hang upon a horizontal bar of a bed rail;

said shorter arm further including a tab extending inwardly toward said longer arm to partially encircle a horizontal bar of a bed rail;

whereby said receptacle is adapted to (a) hang on a horizontal bar of a bed rail, with the lower ends of said longer arms resting against another horizontal bar of said bed rail for stability, or (b) hang on a horizontal bar of a bed rail, with said vertical recess engaged by a vertical bar of said bed rail for stability.

* * * * *